US007540355B2

(12) United States Patent
Härkönen

(10) Patent No.: US 7,540,355 B2
(45) Date of Patent: Jun. 2, 2009

(54) SELF-OPERABLE RESERVE POWER SYSTEM FOR AN ELEVATOR SYSTEM

(75) Inventor: Ari Härkönen, Riihimäki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/078,766

(22) Filed: Apr. 4, 2008

(65) Prior Publication Data

US 2008/0185234 A1 Aug. 7, 2008

Related U.S. Application Data

(63) Continuation of application No. PCT/FI2006/000312, filed on Sep. 25, 2006.

(51) Int. Cl.
*B66B 1/06* (2006.01)

(52) U.S. Cl. ..... 187/290; 187/296

(58) Field of Classification Search ..... 187/290, 187/293, 295, 296, 313; 318/779, 781, 782, 318/799–815; 307/64, 66
See application file for complete search history.

(56) References Cited

U.S. PATENT DOCUMENTS

| | | | | |
|---|---|---|---|---|
| 4,548,299 | A | 10/1985 | Nomura et al. | |
| 4,902,954 | A | 2/1990 | Oshima et al. | |
| 5,894,910 | A * | 4/1999 | Suur-Askola et al. | 187/290 |
| 5,896,948 | A * | 4/1999 | Suur-Askola et al. | 187/290 |
| 6,315,081 | B1 * | 11/2001 | Yeo | 187/290 |
| 7,227,323 | B2 * | 6/2007 | Yamada et al. | 318/376 |
| 2001/0008195 | A1 | 7/2001 | Tajima et al. | |
| 2002/0162705 | A1 | 11/2002 | Shadkin et al. | |
| 2004/0035646 | A1 | 2/2004 | Araki | |

FOREIGN PATENT DOCUMENTS

| | | | |
|---|---|---|---|
| EP | 0 794 919 | B1 | 9/1997 |
| FI | 99108 | C | 10/1997 |
| FI | 99109 | C | 10/1997 |

* cited by examiner

*Primary Examiner*—Jonathan Salata
(74) *Attorney, Agent, or Firm*—Birch, Stewart, Kolasch & Birch, LLP

(57) ABSTRACT

A power control system is operable for controlling and balancing the generation and/or consumption of electrical power through an internal electricity distribution network connected with at least one electrically driven elevator system. The elevator system is connected to the internal electricity distribution network of a particular building, which can further be connected either to the external public electricity distribution network, or to a reserve power appliance. An elevator system includes at least one elevator, an elevator control system, an elevator motor, a frequency convertor fitted to supply the elevator motor which may be in operation when provided with electricity through an external public electricity distribution network, or during disruption of power. A reserve power appliance provides the required electricity to the elevator system, or the elevator system generates its own sustainable electricity, through active management of its power generation and consumption limits over the internal electricity distribution network.

15 Claims, 3 Drawing Sheets

SELF-OPERABLE RESERVE POWER SYSTEM FOR AN ELEVATOR SYSTEM

Figure 1:
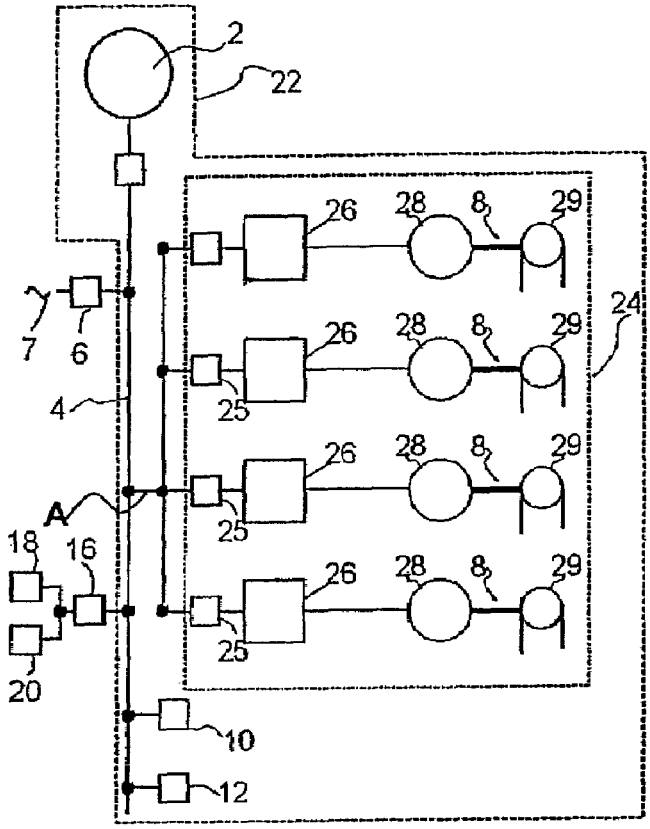

This application is a Continuation of copending PCT International Application No. PCT/FI2006/000312 filed on Sep. 25, 2006, which designated the United States, and on which priority is claimed under 35 U.S.C. § 120. This application also claims priority under 35 U.S.C. § 119(a) on Patent Application No(s). 20051011 filed in Finland on Oct. 7, 2005. The entire contents of each of the above documents is hereby incorporated by reference.

The present invention relates an elevator system, which elevator system can be used both when the internal electricity network of the building is connected to the public electricity distribution network and when the electricity network of the building is connected to a reserve power appliance, and a method for controlling the elevator motor in the elevator.

In a normal operating situation an elevator is controlled such that each time it is used the elevator travels the distance between the departure floor and the destination floor as quickly as possible, taking into account equipment aspects and passenger comfort aspects. Therefore the aim is to control the elevator motor in such a way that the acceleration, deceleration and travel speed of the elevator are as great as possible with regard to the equipment and passenger comfort. The power transmitted via the motor between the electrical system and the traction sheave of the elevator varies according to which direction, at what acceleration or deceleration and with what kind of load the elevator is driving. Depending on the drive situation the elevator motor either converts electrical power into mechanical power, with which the elevator car and any counterweight and rope is moved, or converts mechanical power transmitted to the traction sheave from changes in the potential energy or kinetic energy of the elevator car and counterweight into electrical energy. Some of the power delivered to the motor is consumed in motor losses.

A requirement for controlling the elevator in the manner described above is that the electrical system, to which the elevator drive is connected, is able to adapt to the power requirement of the elevator motor. This means that the electrical system must be able if necessary to both supply electrical power to the motor and to receive electrical power supplied to the electrical system by the motor. In a normal operating situation the electrical power supplied towards the motor is received from the public electricity distribution network. The power supplied towards the electrical system by the motor can be converted to heat in a resistor pack connected for this purpose to the electrical system or the power can be supplied back to the building's internal or the public electricity distribution network for consumption by the other loads connected to the same network. Especially in efficient and fast elevators, in which there is substantial power transmission from the motor towards the electrical system, it is economical to supply the electrical power generated back into the electricity network for utilization in other devices connected to the electricity network. The power supplied towards the electricity network when driving in the lighter direction e.g. in a situation in which an elevator equipped with a counterweight drives at full load and speed downwards or empty upwards, or an elevator without counterweight drives downwards. The electrical power supplied back corresponds at its best to 90% of nominal power. For this reason the motor drives contain a so-called controlled network bridge, which forms current of the correct frequency, form and voltage.

In an exceptional situation, for instance as a consequence of power cuts, the connection of the electrical system of the elevator to the public electricity network can be cut off. As a precaution for these kinds of situations reserve power appliances have been arranged in many buildings, by means of which typically only a part of the electrical devices can be used. In this case also the elevator motor must be able to operate within the limitations of the electrical system. A reserve power system, in which the speed of the elevator motor is regulated so that the power taken by the elevator drive from the network is smaller than an adjustable power limit, is known from publication EP0794919.

In reserve power use some of the loads of the electricity network of the building are typically switched out of use. When an elevator system, which is arranged to supply electrical power back towards the electricity network when driving in the lighter direction, operates in reserve power use, the power supplied by the elevator system towards the network can exceed the load capacity of the electricity network of the building. In this case the voltage of the electricity network rises, and the electrical devices connected to the network can be damaged owing to overvoltage.

According to prior-art it is endeavored to limit the power supplied towards the network of an elevator system such that a separate load is connected to the electrical system of the elevator, such as a resistor pack, to which the power generated when braking or driving in the lighter direction is supplied. A drawback in the prior-art solution is that providing the elevator with a separate load that receives power for situations of disrupted electricity supply increases the costs of the elevator system. A further drawback in using separate loads that consume power is that space must be reserved for these in connection with the machinery of the elevator. Additionally when using a separate load resistance the potential energy of the elevator and passengers is wastefully consumed. In systems in which the electrical power generated by the elevator motor in a normal situation is utilized by supplying it to other loads of the electricity network, procurement of a resistor pack is only necessary in exceptional circumstances.

The elevator system according to the invention is characterized by what is disclosed in the characterization part of claim 1 and the method according to the invention is characterized by what is disclosed in the characterization part of claim 6. Other embodiments of the invention are characterized by what is disclosed in the other claims. Some inventive embodiments are also presented in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts.

The elevator system according to the invention is connected to the internal electricity distribution network of the building, which can be further connected either to the public electricity distribution network or to a reserve power appliance. The elevator system comprises at least one elevator, an elevator control system, an elevator motor and a frequency converter fitted to supply the elevator motor. The elevator system can be used both when the electricity distribution network of the building is connected to the public electricity distribution network and when the electricity distribution network of the building is connected to a reserve power appliance. The elevator system comprises means for controlling the elevator such that when the electricity network of the building is connected to a reserve power system the power supplied by the elevator system towards the electricity network of the building is smaller than the power limit that can be set for it. The elevator system can be fitted to operate such that the elevator system does not supply power to the internal electricity network of the building.

In one embodiment of the invention the elevator system further comprises means for controlling at least one motor such that the electrical power generated by the elevator motor is smaller than the power limit that can be set for generated electrical power. In this case means for consuming electrical power generated by the motor or for storing energy do not need to be arranged in the intermediate circuit of the frequency converter fitted to supply the elevator motor. The power limit can be set to correspond to e.g. the power consumption of the auxiliary devices and of the control system. In one embodiment of the invention the system further comprises means for monitoring the status of the electricity network of the building and for specifying the power limit.

In the method according to the invention for controlling elevators in an elevator system, which elevator system is connected to the electricity distribution network of the building, which can be further connected either to the public electricity distribution network or to a reserve power appliance, and which elevator system comprises at least one elevator, an elevator motor, a frequency converter fitted to supply the elevator motor, an elevator control system and the auxiliary devices of the elevator, and which elevator system can be used both when the electricity network of the building is connected to the public electricity distribution network and when the electricity network of the building is connected to a reserve power appliance, when the electricity network of the building is connected to the reserve power system the elevators are controlled such that the power supplied by the elevator system to the electricity network of the building is smaller than the limit value that can be set for it. In one embodiment of the invention the speed of at least one elevator motor is controlled to be such that the electrical power generated by the elevator motor is smaller than the power limit $P_r$ that can be set for the power generated. According to the method the power needed by the auxiliary devices of the elevator and by the control system of the elevator can further be specified, and the power limit can be set to correspond to the power required by the auxiliary devices and the control system of the elevator. The power limit for power supplied to the network can be specified e.g. such that it corresponds to the power requirement of other equipment of the electricity network as well as that of the elevator system itself.

The elevator system according to the invention can be used both when the electricity network supplying the elevator is connected to the public electricity distribution network and when the electricity network is connected to reserve power. A power limit can be set for the power supplied by the elevator system towards the network, in which case when the elevator system is operating connected to the reserve power supply the power supplied to the electricity network of the system does not exceed the permitted limit. When the limit is set to be such that the power supplied does not exceed the power which can be consumed in the loads of an isolated network, the means for consuming power, such as a resistor pack, normally connected for reserve power use in conjunction with the power supply of an elevator system can be dispensed with. This achieves both cost savings and saves space in the building, as the space required by the elevator machinery is smaller.

It is also possible to limit the power generated by the motors of the elevator system such that it corresponds to the specific power consumption of the elevator and its auxiliary devices. In this case the elevator system operates when driving in the lighter direction fully self-sufficiently, without taking power from the network or supplying power to the network. The reserve power capacity of the building can in this case be utilized for other use.

Figure 2:
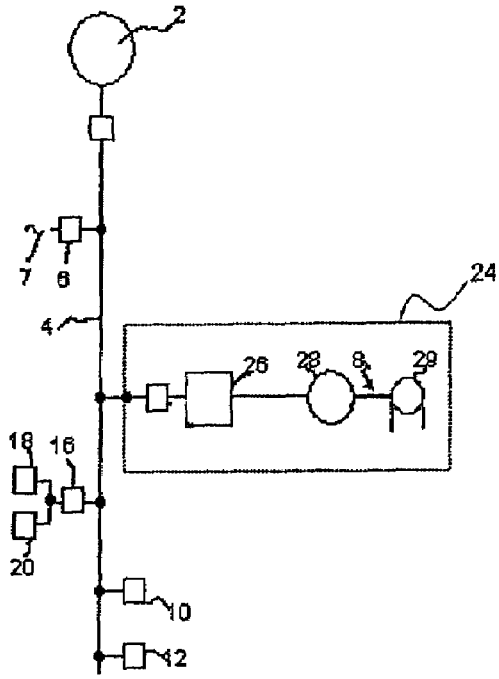
Figure 3A:
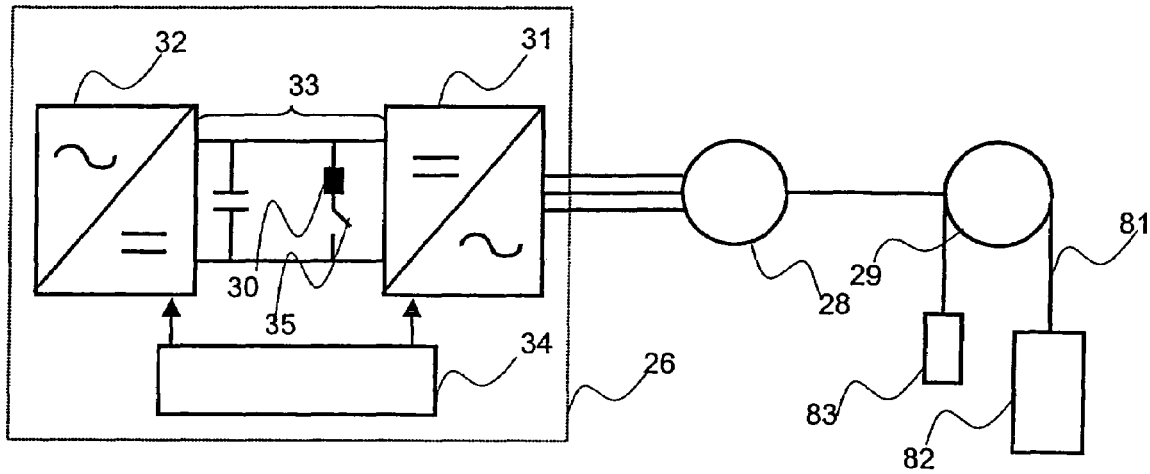
Figure 3B:
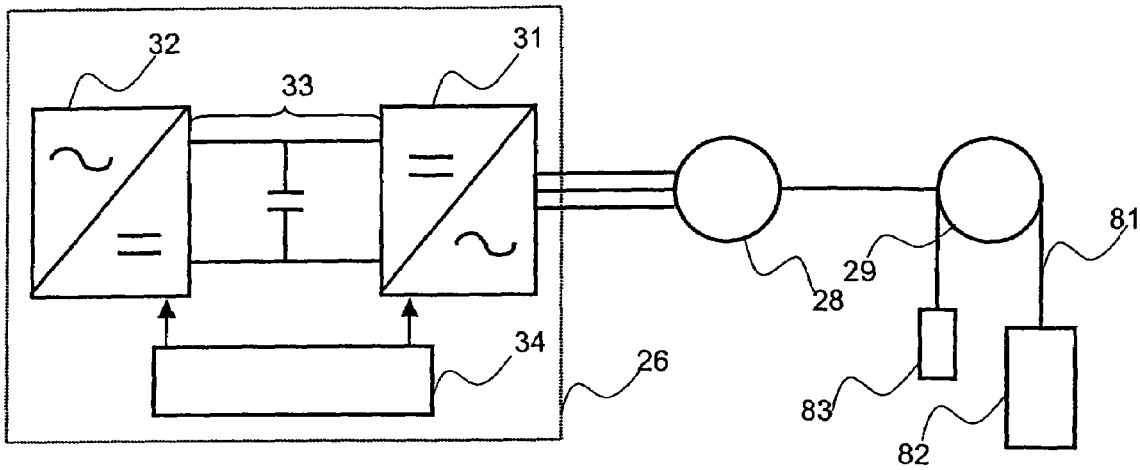

In the following, the invention will be described in more detail by the aid of a few examples of its embodiments with reference to the attached drawings, wherein FIG. 1 illustrates one elevator system according to the invention connected to the internal electricity distribution network of the building FIG. 2 illustrates another elevator system according to the invention connected to the internal electricity distribution network of the building FIG. 3*a* illustrates an electricity supply appliance of a prior-art elevator system FIG. 3*b* illustrates an electricity supply appliance of an elevator system according to the invention FIG. 1 presents an elevator system according to the invention, in which the elevator system 24 comprises four elevators 8. In the elevator system according to FIG. 1 the reserve power machine or reserve power generator 2 in a reserve power situation supplies the power-consuming devices connected to the network via the electricity supply network 4. In a normal operating situation the network 4 is connected via the switch 6 to the external electricity supply network 7, such as the public electricity distribution network. Some of the power-consuming devices are the elevators 8 of the building, of which there are four in this figure, but of which there can be more, and which can be formed into an elevator group 24 subject to the same group control. Of the elevators 8, only the traction sheave 29, drive motor 28 and the regulating device for controlling the motor, such as a frequency converter 26, are presented in FIG. 2. The number of elevators, their grouping into elevator groups and the control devices and auxiliary devices vary in practical implementations. It is also possible that the elevator system comprises its own reserve power source, such as a UPS appliance, which can be connected e.g. to point A of FIG. 1.

Some of the power-consuming devices are appliances which must be operational in an emergency, such as emergency lighting 10, fans 12. In addition the devices in use in the building in a normal situation such as normal lighting 18 and office machines and other machines 20 are connected to the network 4 via the switch 16. The reserve power generator supplies devices which are specified in advance and the others are switched out of operation. For example the devices behind the switch 16 can be switched off if necessary. Consequently the power consumption capacity of the internal electricity network of the building in reserve power use is typically smaller than in a normal operating situation, in which case the supply is received from the public electricity distribution network. As a consequence the power generated by the elevator motors to the electricity network cannot be utilized in reserve power use in the same way as in normal operating conditions.

In order to avoid a rise in the voltage of the electricity network 4, the elevator system 24 may not supply more power to the electricity network 4 than what can be consumed in the loads connected to it. When the elevator system 24 comprises more than one elevator, there is no need to limit the power generated in respect of each individual elevator motor 28 in order to limit the power supplied by the elevator system towards the network. In this case the power generated by one elevator motor can be utilized to move another elevator car. The elevator system according to the invention comprises means for controlling the elevators such that the power supplied by the elevator system towards the network 4 does not exceed the limit value $P_a$ that can be set for it. The motions of the elevators are controlled in the manner of the group control or the other control equipment manner that is in itself prior-art in the directions according to the commands delivered. The speed of the elevators according to the invention and/or the power factor of the elevator motor as well as the departure sequences of the elevators are controlled to be such that the sum of the outputs of the electric motors remains at any given moment below the power limit $P_a$ that can be set. The power generated by the motor of an individual elevator 8 can in this case be greater than $P_a$. It is possible for example that one elevator starts first to drive in the lighter direction, and after this has started another elevator is set to drive in the heavier direction such that the speed of the elevator is adapted to the load of the elevators and the power generated by the motor of the other elevator to a definite value. If UPS is used in the system it is possible to drive for a long time such that the accumulators of the UPS device are not loaded at all. The power supplied towards the network can be minimized, the limit value $P_a$ can also be set to zero, in which case the elevator system does not supply any power at all to the network.

FIG. 2 presents another embodiment of the invention, in which the elevator system 24 comprises one elevator 8, which is controlled by means of a frequency converter 26 and an elevator motor 28. The same numbering has been used in FIG. 2 as in FIG. 1. The operation of the elevator system according to FIG. 2 is described in more detail in the following with reference to FIGS. 3*a* and 3*b*.

FIG. 3*a* presents a prior-art elevator system comprising one elevator applicable to high-rise buildings, which is designed to be operable both in reserve power use and when normally connected to the network. Reserve power means here a situation in which the internal electricity distribution network of the building, to which the elevator system is connected, is supplied by a generator, by means of the accumulators of an uninterruptible power source (UPS) or by another applicable appliance arranged to supply electrical energy to the network. The elevator car 82 is moved by the motor 28, which is supplied by a frequency converter 26, via the hoisting ropes 81 and the traction sheave 29 of the elevator. The frequency converter 26 comprises two controllable rectifier units 31,32 and a direct-voltage intermediate circuit 33 between them, to which a resistance pack 30 is connected. A capacitor can additionally be connected to the intermediate circuit. The frequency converter is controlled by means of the elevator control system 34. The elevator system of FIGS. 3*a* and 3*b* contains in addition a counterweight 83, the mass of which typically corresponds to approximately 50% of the mass of the elevator car with a full load. The elevator system of FIG. 3*a* operates as follows, when the elevator system is connected to the public electricity distribution network. When the elevator drives in the heavier direction, e.g. when moving an empty elevator car downwards, power is transmitted from the electricity network by means of the rectifier units 31 and 32 to the motor 28. When the elevator is driving in the lighter direction the motor 28 generates electrical power, which is supplied by means of the frequency converter 26 back to the electricity network for consumption by the devices connected to the network. When the elevator system is connected to an electricity network, which receives its supply from reserve power, maximum power is not necessarily available from the electrical system, in which case it may be necessary to limit the travel speed of the elevator when driving in the heavier direction. This type of solution is known from e.g. publication EP0794920. Owing to the change in the potential energy and kinetic energy of the elevator car, when driving in the lighter direction the generated power can be supplied to the other elevators of the elevator group or to other electrical devices. If there is a risk that the generated power exceeds the power requirement of the loads of the electricity network, the power generated in the electric motor is consumed in the resistor pack 30 connected to the frequency converter, which can be connected e.g. by means of the switch 35 of its intermediate circuit 33, i.e. the electrical energy is converted to heat. In connection with the elevator groups it is further possible to consume energy supplied to the network by driving elevators belonging to another group at zero speed, in which case the elevator motor consumes an amount of power equivalent to its losses, or by supplying the generated power for driving an elevator of another elevator group in the heavier direction. In connection with elevator systems which contain only one elevator this is not, however, possible.

FIG. 3*b* describes an elevator system according to the invention. In FIG. 3*b* the parts of the elevator system are numbered in the same way as in FIG. 3*a*. The elevator system according to the invention otherwise operates in the same way as the prior-art elevator system described above, but in the elevator system according to the invention the power supplied by the motor 28 towards the network is limited in reserve power use such that the power generated by the electric motor 28 does not in any operating situation exceed the load capacity of the other devices 10,12,18,20 connected to the electricity network. In this case the power generated by the electric motor can be supplied through the frequency converter 26 back to the electricity network also in reserve power use, and the resistor pack 30 presented in FIG. 3*a* for consuming power or an energy store is not needed in the intermediate circuit 33 or elsewhere in connection with the electricity supply system. By dispensing with the resistor pack it is possible to achieve substantial cost savings in the elevator system, and in addition the space required in the building by the electricity supply appliances of the elevator system is smaller.

In the elevator system according to the invention the frequency converter 26 controls the motor 28 in reserve power use such that the power generated by the motor does not exceed the power limit $P_r$ that can be set for it. If the elevator system comprises only one elevator, the power limit $P_r$ can be set also as the power limit $P_a$ of the power supplied by the elevator system to the network.

When the motor is functioning as a generator the distribution of power can be expressed with the equation $P_m=P_e+P_l$, where $P_m$=mechanical power on the shaft of the motor, $P_e$=generated electrical power and $P_l$=power loss. The power $P_m$ is proportional to the speed of rotation of the motor, so the power generated by the motor can be limited in elevator use e.g. such that the speed of rotation of the motor is limited. In this case the speed reference, with which the frequency converter drives the motor, can be formed based on the power limit $P_r$ that can be set and on the load data. It is further possible to limit the generated power such that the proportion of the of the shaft power that is the power loss $P_l$ is increased, e.g. by changing the power factor with which the motor is supplied. In this case the generated power $P_e$ decreases.

The power limit $P_r$ can be selected e.g. such that the power limit corresponds to the sum of the power required by the control system 34 and the auxiliary devices, such as the lighting 10 and the fans 12, if necessary with the losses of the frequency converter added. In this case the load capacity of the other devices 18, 20 possibly connected to the electricity network does not need to be utilized.

It is also possible that the elevator system comprises means, with which the status of the electricity network can be monitored, in which case by comparing the reserve power supplied to the electricity network to the power of the elevator system at the same time it is possible to specify the electrical power consumed by the other devices 10,12,18,20 connected to the electricity network, and further to set the power limit $P_a$ and/or $P_r$ such that the power limit corresponds to the power required by the devices connected to the electricity network. The power limits $P_a$ and $P_r$ can also be specified on another appropriate basis.

In an emergency people are typically leaving the building, in which case the elevator cars travel downwards loaded and upwards empty, in other words in the case of an elevator with counterweight they are driven in the lighter direction when moving both upwards and downwards. In one preferred embodiment of the invention the power of the electric motors is limited such that the power generated by the motors corresponds to the specific power consumption of the elevator system itself and its auxiliary devices. In this case the elevator system can operate fully self-sufficiently, without taking power from the network or supplying power to the network. The elevator system can thus be available for evacuation drive also in a situation in which the internal electricity network of the building is completely without a separate power supply, i.e. when the network has no connection with the public electricity network and the reserve power appliance is not connected or not available for some other reason.

If the elevator system includes only one elevator, the generated power can be consumed in the control system of the elevator and in the auxiliary devices of the elevator. In an elevator system comprising more than one elevator it is further possible to supply power also to the other motors of the elevator system.

The inventive concept also includes a method for controlling the elevators in an elevator system. The drive directions and destination floors of the elevators are specified using a method that is in itself prior-art. In accordance with the invention when the electricity network of the building is connected to the reserve power supply the departure sequence and travel speeds of the elevators and/or the power factors of the elevator motors are controlled such that the power supplied by the elevator system to the electricity network does not exceed the power limit that can be set for it. In an elevator system comprising more than one elevator the power generated by the motor of an individual elevator can be utilized for use by another elevator, and the travel speeds of the elevators and/or the power factors of the motors can be adapted such that the power supplied by the elevator system towards the network remains below the permitted limit $P_a$.

In one embodiment of the invention the speed of at least one elevator motor is controlled to be such that the electrical power generated by the elevator motor is smaller than the power limit $P_r$ that can be set for the generated power. Regulation of the speed of the motor can be implemented by methods that are in themselves prior-art. The method can also comprise specification of the power limit $P_a$ and/or $P_r$ itself. For specifying the power limit it is possible e.g. to specify the power required by the auxiliary devices, the power required by the control system of the elevator, and to set a power limit that corresponds to the power required by the auxiliary devices and the control system. It is further possible to specify the power supplied by the reserve power appliance to the electricity network of the building and simultaneously the power taken from or supplied to the network by the elevator system, and to specify the power requirement of the other devices connected to the electricity network of the building by comparing the power supplied by the reserve power appliance to the network and the power taken or supplied by the elevator system. The power limit $P_a$ and/or $P_r$ can be set such that it corresponds to the power requirement of the other devices of the electricity network as well as of the elevator system itself.

The invention is described above by the aid of some embodiments. The embodiments are not however to be regarded as restricting the scope of protection of the patent, but instead the embodiments of the invention can vary within the scope defined in the claims below.

The invention claimed is:

1. Elevator system, which elevator system is connected to an internal electricity distribution network of the building, which selectively connects between a public electricity distribution network and a reserve power appliance, and which elevator system comprises:

at least one elevator;

an elevator control system;

an elevator motor;

a frequency converter fitted to supply the elevator motor;

an internal electricity distribution network to control the at least one elevator such that when the internal electricity distribution network of the building is connected to the reserve power appliance;

wherein the elevator system can be used both when the internal electricity distribution network of the building is connected to the public electricity distribution network and when the internal electricity distribution network of the building is connected to a reserve power appliance and wherein the frequency converter will operate to manage the power supplied by the elevator system towards the internal electricity distribution network in direct relation to the demand capacity for electric power consumption of the internal electricity distribution network, such that total power supply towards the internal electricity distribution network does not exceed the power limit $P_a$ that can be set for the total power supply towards the internal electricity distribution network, and in order to avoid a rise in the voltage of the internal distribution network.

2. Elevator system according to claim 1, further comprises the elevator system does not supply power to the internal electricity distribution network of the building.

3. Elevator system according to claim 1 or 2, further comprises a frequency converter to control at least one elevator motor of an elevator from the elevator system such that the electrical power generated by the at least one elevator motor is smaller than the power limit $P_r$ that can be set for the generated electrical power of the internal electricity distribution network.

4. Elevator system according to claim 1, further comprises the frequency converter fitted to supply the at least one elevator motor comprises two controllable rectifier units and a direct-voltage intermediate circuit between them, wherein the intermediate circuit does not consume the electrical power generated by the at least one elevator motor.

5. Elevator system according to claim 1, further comprises the power limit $P_a$ and/or $P_r$ is set to correspond to the power consumption of any auxiliary devices that are connected through the internal electricity distribution network and operable by the control system.

6. Elevator system according to claim 1, further comprises an internal electricity distribution network to monitor the status of the internal electricity distribution network of the building and for specifying the power limit $P_a$ and/or $P_r$.

7. Method for controlling elevators in an elevator system, which elevator system is connected to an internal electricity distribution network of the building, which selectively connects between a public electricity distribution network and a reserve power appliance, and which elevator control system comprises:

providing at least one elevator operable with the control system;

providing an elevator motor operable with the control system;

providing a frequency converter fitted to supply the elevator motor operable with the control system;

providing an internal electricity distribution to control the at least one elevator such that when the internal electricity distribution network of the building is connected to the reserve power appliance;

wherein the elevator control system can be used both when the internal electricity distribution network of the building is connected to the public electricity distribution network and when the internal electricity distribution network of the building is connected to a reserve power appliance and wherein the frequency converter will operate to manage the internal electricity distribution network of the building being connected to a reserve power system when the power supplied by the elevator system towards the internal electricity distribution network of the building is smaller than the power limit $P_a$ that can be set for the internal electricity distribution network.

8. Method according to claim 7, further comprises the speed of at least one elevator motor is controlled so the electrical power generated by the elevator motor is smaller than the power limit $P_r$ that can be set for the power generated for the internal electricity distribution network.

9. Method according to claim 7 or 8, further comprises the steps:

(a) providing the power for peak consumption required by the auxiliary devices of the elevator being specified; and (b) providing the power for peak consumption required by the control system of the elevator being specified.

10. Method according to claim 9, further comprises the step:

(c) providing the power limit $P_a$ and/or $P_r$ is set to correspond to the power for peak consumption required by the auxiliary devices and the control system of the elevator.

11. Elevator system according to claim 1, further comprising the frequency converter fitted to supply the at least one elevator motor, comprises two controllable rectifier units and a direct-voltage intermediate circuit, wherein the intermediate circuit does not store the electrical power generated by the at least one elevator motor.

12. Elevator system according to claim 1, further comprising the frequency converter fitted to supply the at least one elevator motor, comprises two controllable rectifier units and a direct-voltage intermediate circuit, wherein the intermediate circuit need not store the electrical power generated by the at least one elevator motor, since the frequency converter is operable to balance any production of electricity by the at least one elevator motor with the consumption of electricity by any other elevator motor, the control system, and auxiliary devices connected through the internal electricity distribution network.

13. Elevator system according to claim 1, further comprising the frequency converter fitted to supply the at least one elevator motor, comprises two controllable rectifier units and a direct-voltage intermediate circuit, wherein the intermediate circuit does not store the electrical power generated by the at least one elevator motor.

14. Elevator system according to claim 1, further comprising the electrical power generated by the at least one elevator motor is functioning as a generator with the distribution of power connected to the internal electricity distribution network represented by $P_m=P_e+P_l$, where $P_m$ equals mechanical power (relative to a shaft of the at least one elevator motor), $P_e$ equals the generated electrical power, and $P_l$ equals the lost electrical power.

15. Elevator system according to claim 3, further comprising the electrical power generated by the at least one elevator motor is functioning as a generator with the distribution of power connected to the internal electricity distribution network represented by $P_m=P_e+P_l$, where $P_m$ equals mechanical power (relative to a shaft of the at least one elevator motor), $P_e$ equals the generated electrical power, and $P_l$ equals the lost electrical power; and the power generated by the at least one elevator motor is limited based on the power limit $P_r$.

* * * * *